United States Patent [19]

Knosky

[11] 4,393,613

[45] Jul. 19, 1983

[54] PROJECTILE LUBRICATING AND MUZZLE LOADING DEVICE FOR GUN

[76] Inventor: Ronald J. Knosky, R.D. #3 - Box 166, Leechburg, Pa. 15656

[21] Appl. No.: 187,418

[22] Filed: Sep. 15, 1980

[51] Int. Cl.[3] ..... F41C 27/00

[52] U.S. Cl. ..... 42/90

[58] Field of Search ..... 42/90; 86/19

[56] References Cited

U.S. PATENT DOCUMENTS

| | | | |
|---|---|---|---|
| 1,565 | 4/1840 | Clark | 42/90 |
| 4,152,858 | 5/1979 | Dobbs | 42/90 |
| 4,254,572 | 3/1981 | Nelson | 42/90 |

*Primary Examiner*—Charles T. Jordan

*Attorney, Agent, or Firm*—James Irwin

[57] ABSTRACT

A projectile lubricating and muzzle loading device for muzzle loading guns is disclosed. The device comprises a body structure having a top surface and a bottom surface for placing on the muzzle of the gun when inserting a projectile thereinto. In addition, the body structure of the device includes an aperture adapted to receive and hold the projectile during lubrication and to align the projectile with the muzzle of the gun for loading purposes, the aperture defined by a side wall structure extending from and connecting the top surface to the bottom surface and having the axis thereof aligned substantially at right angles with the bottom side. The device includes means for introducing lubrication to the aperture when the projectile is held therein.

7 Claims, 4 Drawing Figures

PROJECTILE LUBRICATING AND MUZZLE LOADING DEVICE FOR GUN

INTRODUCTION

This invention relates to muzzle loading guns and more particularly it relates to a projectile lubricating and loading device for muzzle loading guns.

When using muzzle loading guns of the black powder type, it has been found that greater accuracy and range can be maintained on a consistent basis if the projectile to be fired has been lubricated prior to firing. The lubrication has the effect of resisting pick-up or build-up of metal from the projectile on the bore of the gun and interference with firing of subsequent projectiles. In applying lubricant to the projectile it is important that a uniform coating be applied. That is, it is important to apply an effective coating of lubricant so as to ensure against adverse metal to metal contact as the projectile is propelled out the bore of the gun. Further, it is important to avoid excess lubricant since this can result in contamination of the gun powder and diluting the effectiveness of the charge and the attendant interference with accuracy. With respect to projectiles of the type having a cone-shaped nose, a cylindrical body, and a base which is substantially flat, it is particularly important that the flat portion is lubricant free, since it is the part of the projectile which is rammed up against the powder. Yet it is equally important that sufficient lubricant be provided adjacent the base on the cylindrical portion to provide a temporary seal against escaping gases on firing the gun.

The present invention provides a device for applying a uniform coating of lubricant to a projectile and ensures against accidental contamination of the gun powder. Further, upon lubrication the projectile can be transferred directly from the device into the muzzle by use of a ramrod which avoids additional handling steps.

SUMMARY OF THE INVENTION

An object of the present invention is to provide a device for lubricating projectiles used in muzzle loading guns.

Another object of the present invention is to provide a device for lubricating and loading a projectile into a muzzle loading gun.

Yet another object of the present invention is to provide a device particularly suitable for lubricating projectiles of the type having a cone-shaped nose, a cylindrical body and flat base used in muzzle loading guns.

These and other objects will become apparent from the drawings, specification and claims attached hereto.

In accordance with these objects, there is disclosed a projectile lubricating and muzzle loading device for muzzle loading guns. The device comprises a body structure having a top surface and a bottom surface which is adapted to be placed on the muzzle of the gun when inserting a projectile thereinto. The body structure of the device also includes an aperture designed to receive and hold the projectile during lubrication and to align the projectile with the muzzle of the gun for loading purposes. The aperture is defined by a side wall structure extending from and connecting the top surface to the bottom surface and has the axis thereof aligned substantially at right angles with the bottom side. The device includes means for introducing lubrication to the aperture when the projectile is contained therein.

DETAILED DESCRIPTION OF THE PREFERRED EMBODIMENTS

Figure 1:
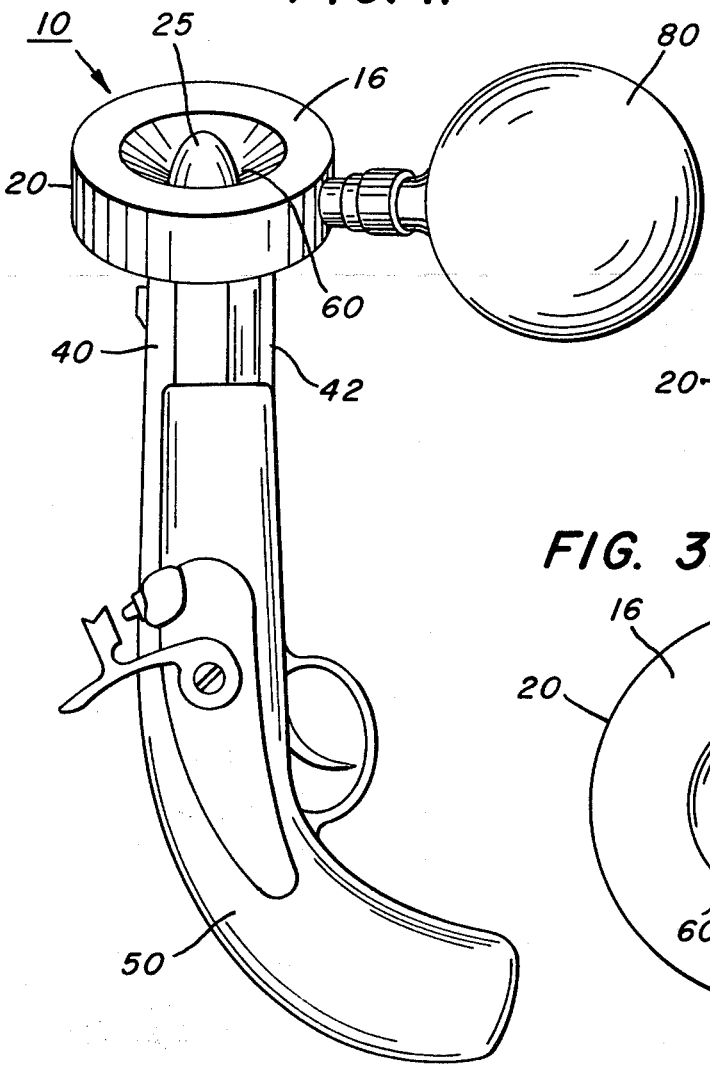
FIG. 1 is a perspective view showing the device containing a projectile, the device positioned on the muzzle of a gun prior to the projectile being inserted thereinto for firing.

Referring now more specifically to FIG. 1, there is shown a projectile lubricating and muzzle loading device, referred to generally as 10, placed or positioned on muzzle 40 of gun 50. The lubricating and loading device comprises a top surface referred to generally as 16, a side wall structure 20 which connects the top surface to bottom surface 30. Attached to side wall 20 is a lubricant reservoir or dispenser 80. In the embodiment in FIG. 1, a hexagonal shaped gun barrel is shown. However, it should be understood that the lubricating and muzzle loading device of the present invention can be used with gun barrels which have a circular configuration. Also, in the embodiment shown in FIG. 1, a projectile 25 is shown positioned in the lubricating and loading device. The projectile can easily be inserted into muzzle or barrel 40 of gun 50 for purposes of firing. It will be noted from FIG. 1 that the projectile can be loaded by use of a ramrod. That is, in the present invention, after the projectile has been lubricated, it can be loaded directly into the gun without further touching of the projectile by the fingers. This in itself is significant feature since the coating of lubricant provided on the projectile remains uniform and is not further disturbed. Further, this method of loading the lubricated projectile avoids getting lubricant on the fingers and on the gun and problems attendant thereto.

Figure 2:
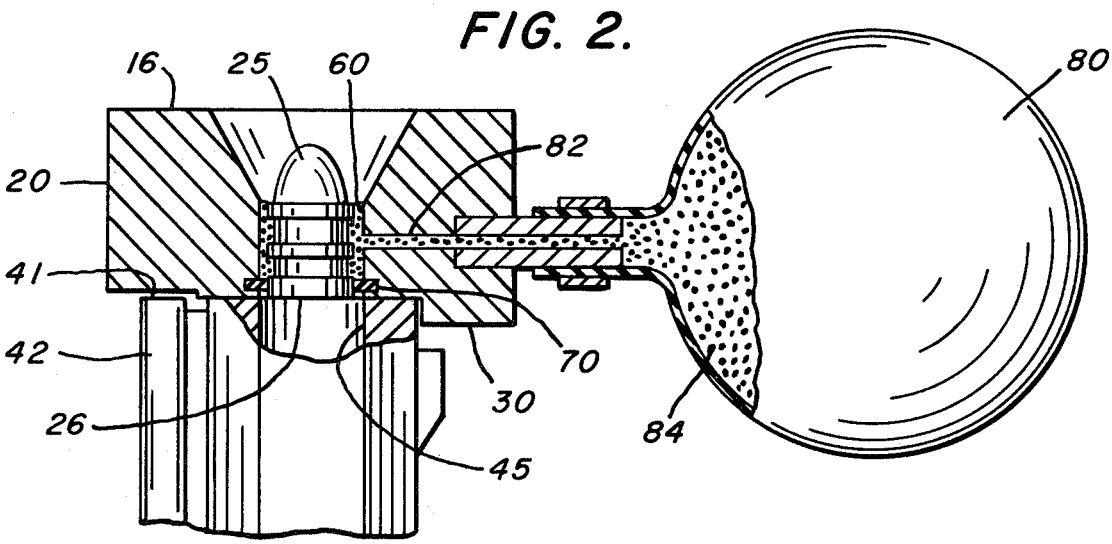
FIG. 2 is a cross-sectional view showing the device with projectile, the device positioned on the muzzle of a gun with the projectile axially aligned with the muzzle bore.

The lubricating and loading device of the present invention has an aperture 60 which extends from top surface 16 to bottom surface 30 as will be best seen in FIG. 2. The aperture should be designed to accommodate the particular size of caliber or projectile which is being used. However, it is important that the fit between projectile and aperture is not too tight or snug. That is, the tolerance should be such that residual air in the aperture after the projectile has been inserted can escape particularly at the top surface when lubricant is forced into aperture to lubricate the projectile. If the tolerance is too snug particularly adjacent the nose of the projectile at the top surface improper or inadequate lubrication can result or lubricant can be forced towards the base of the projectile where, as noted earlier, it can adversely effect the gun powder. Typically, clearance should not be much less than 0.005 inches with a clearance of about 0.007 inches having been found to be quite suitable. For example, if the projectile is 0.500 inches in diameter than a suitable aperture would be at least about 0.514 inches in diameter except adjacent the base of projectile where it is desired to prevent flow of lubricant.

Upon examination of FIG. 2, it will be noted that means 70 is provided in aperture 60 to prevent or restrict flow of lubricant towards base 26 of projectile 25.

It will be understood that means 70 may be material of construction for side wall 20, e.g. metal, hard plastic, or wood. However, this can require very exact machining and does not permit much variation in the diameter of the projectile. Accordingly, it is preferred that means 70 be a resilient member. Thus, for example, if device 10 is fabricated from a metal such as aluminum, then a groove may be provided in the wall of the aperture for purposes of inserting a resilient ring member therein which will cooperate with the projectile cylindrical shaped wall adjacent the projectile base as shown in FIG. 2, for example, to prevent lubricant escaping towards the base of the projectile. A highly suitable ring member which has been found to work in this application is an O-ring fabricated from a rubber type material.

With respect to the projectile 25 for which the device of the instant invention is particularly suited these are commonly of the type having grooves or circular recessed bands as shown in FIG. 2, and which can have flat or a concave shaped base. Since the projectile can have one or more grooves it is important that the ring member 70 be located so as to be positioned between the base and the nearest-to-the-base groove when the projectile is contained in the aperture for purposes of adding lubricant thereto.

In the embodiment of the invention illustrated in FIG. 2, it will be seen that lubricant is injected or transferred from lubricant dispenser 80 via conduit or channel 82. Dispenser 80 can be any dispensing means which when pressure is applied thereto, lubricant is forced into aperture 60 and into grooves in the projectile. For example, dispenser 80 can be a rubber bulb filled with lubricant which responds to hand pressure to inject lubricant. Channel 82 is preferably located close to ring member 70 in order to ensure against entrapment of air when lubricant is injected.

In lubricating the projectile in accordance with the invention, sufficient lubricant 84 is injected to the aperture when a small amount of lubricant can be seen to ooze or exude out between the projectile and the top surface as can be seen in FIG. 2. Further, it will be understood that a small excess of lubricant on the nose of the projectile does not adversely affect firing as noted earlier with respect to the base. Additionally, it will be noted that ring member 70 also serves to ensure that substantially the same amount of lubricant adheres each time to the projectile as it is inserted or pushed into bore 45 of muzzle or barrel 40 by means of a ramrod pushing on the nose of projectile 25. With respect to inserting the projectile into the lubricating device, proper procedure requires that the nose 25 of the projectile be inserted into aperture 60 through bottom surface 30 since this too ensures that residual lubricant in the aperture does not contaminate the base of the projectile.

Figure 4:
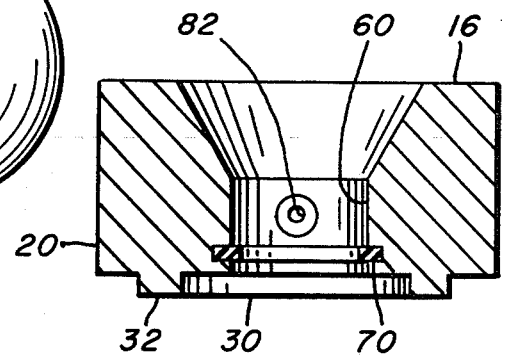
FIG. 4 is a cross-sectional view along the line A—A. of FIG. 3.
Figure 3:
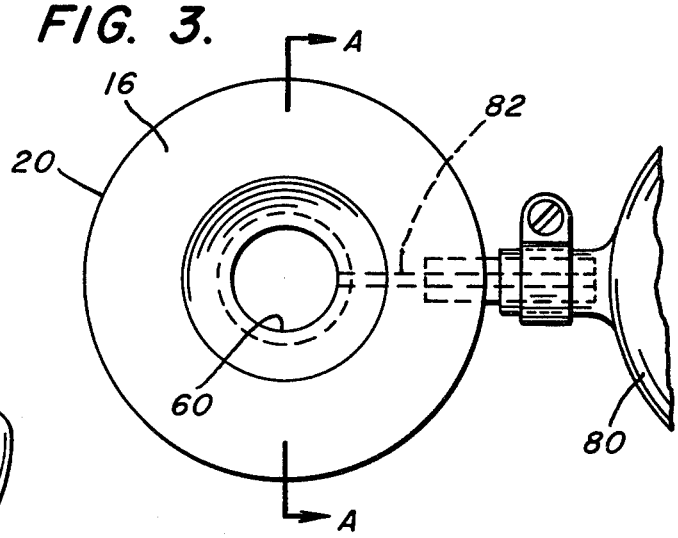
FIG. 3 is a top view of the device.

With respect to FIGS. 3 and 4, a preferred aspect of the invention requires that the opening of aperture 60 at top surface 16 be funnel shaped. This funnel shaped opening facilitates the ease with which a ramrod can be positioned over the nose of the projectile. For purposes of locating aperture 60 over bore 45, FIG. 2, means for axially aligning device 10 can be provided or attached thereto. Means for axially aligning the aperture of the device with the bore can be spring-like members (not shown) which firmly hold the device on the muzzle. Another means for axially aligning the aperture and bore can be a ring member 32 (FIG. 4) which fits over the muzzle (FIG. 2) and prevents device 10 from slipping from the muzzle. If device 10 is fabricated from a solid material, ring member 32 can be provided by recessing a portion of bottom surface 30 substantially axially with the aperture opening. Ring member 32 can accommodate the outside of the muzzle regardless of whether it is circular or hexagonal or the like in cross-section. In certain models of guns, it may be found that end 41 of thimble 42 which is used for carrying the ramrod and usually located under the barrel extends so as to project to the end or near the end of muzzle. This end of the thimble can sometimes interfer with axially aligning device 10 on the muzzle and in such instance bottom surface 30 may be further machined as shown in FIG. 2 to accommodate the end of the thimble.

While the invention has been described in terms of preferred embodiments, the claims appended hereto are intended to encompass other embodiments which fall within the spirit of the invention.

What is claimed is:

1. A projectile lubricating and muzzle loading device for muzzle loading guns comprising a body structure having:

(a) a top surface;

(b) a bottom surface for placing on the muzzle of the gun when inserting a projectile thereinto;

(c) an aperture adapted to receive and hold said projectile during lubrication and to align said projectile with the muzzle of the gun for purposes of loading, said aperture defined by a side wall structure extending from and connecting the top surface to the bottom surface, and having the axis thereof aligned substantially at right angles with the bottom surface;

(d) a resiliant member located in said aperture which cooperates with the projectile when placed in said aperture, said member adapted to restrict the flow of lubricant towards the rear of the projectile thereby preventing contamination of the powder with the lubricant when the projectile is loaded into said muzzle for firing; and (e) means for introducing lubricant to said aperture when the projectile is held therein.

2. The device in accordance with claim 1 including means for aligning the aperture on the muzzle for purposes of transferring the projectile from the aperture into the muzzle.

3. The device in accordance with claim 1 wherein the bottom surface has means therein for aligning the aperture with the muzzle for purposes of transferring the projectile from the aperture into the muzzle.

4. The device in accordance with claim 1 where the bottom surface has a recessed area for receiving the muzzle thereinto and centering said aperture over the muzzle for purposes of transferring the projectile from said aperture to said muzzle.

5. The device in accordance with claim 1 wherein said means for introducing lubricant to said aperture when the projectile is contained therein is a conduit through said side wall structure to a lubricant reservoir, said conduit located between said means for restricting lubricant flow and said top surface.

6. The device in accordance with claim 1 wherein the opening in said top surface is funnel shaped for ease of placing a ramrod thereinto when loading said projectile into said muzzle.

7. A projectile lubricating and muzzle loading device for muzzle loading guns, the device comprising a body structure having:

(a) a top surface;

(b) a bottom surface for placing on the muzzle of the gun when inserting a projectile thereinto, the bottom surface having a ring shaped member thereon for receiving the muzzle thereinto and aligning said device therewith for purpose of loading a projectile into the muzzle;

(c) an aperture adapted to receive and hold said projectile during lubrication thereof and defined by a side wall structure extending from and connecting the top surface to the bottom surface, the axis of said aperture aligned substantially at right angles with the bottom surface and substantially coinciding with the axis of said ring member thereby aligning the projectile contained in said aperture with the muzzle of the gun for loading the projectile thereinto when the bottom surface is placed on the muzzle;

(d) a resilient member contained in said aperture which cooperates with the projectile when placed in said aperture to restrict the flow of lubricant towards the rear of the projectile thereby preventing contamination of powder with lubricant when the projectile is loaded into said muzzle for firing;

(e) a conduit located in said side wall structure between said resilient member and said top surface, said conduit designed to introduce lubricant into said aperture from a lubricant reservoir when the projectile is contained in the aperture.

* * * * *